US008653918B2

(12) United States Patent
Di Maio et al.

(10) Patent No.: US 8,653,918 B2
(45) Date of Patent: Feb. 18, 2014

(54) SINGLE COIL ACTUATOR FOR LOW AND MEDIUM VOLTAGE APPLICATIONS

(75) Inventors: Luciano Di Maio, Milan (IT); Massimo Bresciani, Villa di Serio (IT); Gabriele Valentino De Natale, Milan (IT)

(73) Assignee: ABB Technology AG, Zurich (CH)

( * ) Notice: Subject to any disclaimer, the term of this patent is extended or adjusted under 35 U.S.C. 154(b) by 105 days.

(21) Appl. No.: 12/566,356

(22) Filed: Sep. 24, 2009

(65) Prior Publication Data

US 2010/0079226 A1 Apr. 1, 2010

(30) Foreign Application Priority Data

Sep. 29, 2008 (EP) ..... 08165332

(51) Int. Cl.
*H01H 9/02* (2006.01)
*H01H 13/04* (2006.01)

(52) U.S. Cl.
USPC ..... 335/202; 335/78

(58) Field of Classification Search
USPC ..... 335/78–8, 128–132, 202
See application file for complete search history.

(56) References Cited

U.S. PATENT DOCUMENTS 6,794,968 B2 * 9/2004 Arnholt ..... 335/179
7,902,947 B2 3/2011 Lefebvre
7,911,304 B2 3/2011 Yano et al.
2008/0061171 A1 * 3/2008 Bayer ..... 239/585.3
2008/0157905 A1 * 7/2008 Parker et al. ..... 335/131
2008/0246569 A1 * 10/2008 Bogdon et al. ..... 335/256
2009/0096559 A1 * 4/2009 Yano et al. ..... 335/187

FOREIGN PATENT DOCUMENTS

DE 1295690 B * 5/1969
EP 0816553 2/2009
WO 2007128892 11/2007
WO 2007132773 11/2007

* cited by examiner

*Primary Examiner* — Bernard Rojas

(74) *Attorney, Agent, or Firm* — Paul R. Katterle; Melissa J. Szczepanik

(57) ABSTRACT

A single-coil actuator for low or medium voltage applications which comprises a first assembly which comprises a first casing having a first half-casing and a second half-casing coupled to each other. The first casing defines an internal space housing an electromagnet having a coil and an armature movable between two positions. The first half-casing has a first opening for the mechanical coupling of the armature with an external element, while one of the first or second half-casing has a second opening for the electrical connection of the electromagnet. The electrical connection comprises a first connection element of the socket and plug-type connection which is electrically connected to the coil and positioned in correspondence of the second opening.

12 Claims, 6 Drawing Sheets

SINGLE COIL ACTUATOR FOR LOW AND MEDIUM VOLTAGE APPLICATIONS

CROSS-REFERENCE TO RELATED APPLICATION

This application claims priority under 35 U.S.C. §119(a) of an application filed in the European Patent Office on Sep. 29, 2008 and assigned Serial No. 08165332.1, which is hereby incorporated by reference in its entirety.

BACKGROUND OF THE INVENTION

The present invention relates to a single coil actuator for low and medium voltage applications, in particular to a single coil actuator based on a single coil electromagnet having improved features in terms of performances and construction. The single coil actuator of the invention is conveniently used in low and medium voltage apparatuses. For the purposes of the present application the term medium voltage is referred to applications in the range of between 1 and 50 kV and low voltage is referred to applications in the range below 1 kV.

Coil-based actuators are frequently used in medium and low voltage apparatuses, for instance in low or medium voltage circuit breakers, disconnectors or contactors, for a wide variety of applications. A typical use of coil-based actuators is to release or lock mechanical parts of spring-actuated circuit breaker, following an opening or closing command. Other typical uses are, e.g., locking magnet for truck, command locking, and similar.

Conventional coil-based actuators normally comprise an electronics that drives two windings which are selectively energized for moving the anchor associated thereto ("launch" operation) and for maintaining it into position ("hold" operation). The two windings are powered directly from the supply rail and switched using two MOSFETs: the first coil is switched on to launch the electromagnet and the second coil allows to keep the electromagnet into position.

Even if conventional coil-based actuators are widely and satisfactorily used, they have however a number of disadvantages.

A first problem derives from the high number of variants which are needed to cover all operational ranges. As an example, up to 7 electromagnet variants are needed to support all voltage and current (AC and DC) operational ranges. In turn, each electromagnet variant needs its own driving electronics. Such a high number of variations has a negative impacts on manufacturing and handling costs.

Another disadvantage derives from the coil manufacturing; in particular the "hold" winding requires an high number of turns with very low wire sections. This makes the coil expensive.

Another disadvantage derives from the possibility to interface the coil either with dedicated electronics or with electronics already on-board of the medium or low voltage apparatus in which the coil is installed. Normally, the electromagnet is connected to the electronic box using cables that need manual forming and soldering on the coil winding. This requires a further possible variant in the design of the coil, as well as the need of soldering operation of the connections.

It is therefore an aspect of the present invention to provide a coil-based actuator for medium or low voltage applications in which the above-mentioned drawbacks are avoided or at least reduced.

More in particular, it is an aspect of the present invention to provide a coil-based actuator for medium or low voltage applications having a simplified design, maintaining at the same time the performances and the reliability needed for the intended applications.

As a further aspect, the present invention is aimed at providing a coil-based actuator for medium or low voltage applications that can be easily adapted to a wide number of intended applications.

Still a further aspect of the present invention is to provide a coil-based actuator for medium or low voltage applications that can be easily interfaced with dedicated electronics or with electronics already on-board of the medium or low voltage apparatus in which the actuator is installed.

As a further aspect, the present invention is aimed at providing a coil-based actuator for medium or low voltage applications having a reduced number of mechanical parts.

Still another aspect of the present invention is to provide a coil-based actuator for medium or low voltage applications with reduced manufacturing and installation costs.

SUMMARY OF THE INVENTION

Thus, the present invention relates to a single-coil actuator for low or medium voltage applications which comprises a first, electromechanical, assembly which comprises a first casing having a first half-casing and a second half-casing coupled to each other; the first casing defines an internal space housing an electromagnet having a coil and an armature movable between two positions. In the actuator according to the invention, said first half-casing has a first opening for the mechanical coupling of said armature with an external element, while one of said first or second half-casing has a second opening for the electrical connection of said electromagnet, said electrical connection comprising a first connection element of the socket and plug-type connection, said first connection element being electrically connected to said coil and positioned in correspondence of said second opening.

In this way, it is possible to overcome some of the disadvantages and drawbacks of the coil-based actuators of the known art. In particular, the design is extremely simplified and based on a few number of components with consequent savings of manufacturing costs. The particular type of electrical connection, as well as its positioning, allows to easily and directly interface the single-coil actuator either with dedicated electronics or with electronics already on-board of the medium or low voltage apparatus in which the actuator is installed, without any needs of connecting cables and related manual forming and soldering operation as in the coil-based actuator of known type. Consequently, the number of manufacturing variants is reduced.

BRIEF DESCRIPTION OF THE DRAWINGS

Further characteristics and advantages of the invention will emerge from the description of preferred, but not exclusive embodiments of the single-coil actuator according to the invention, non-limiting examples of which are provided in the attached drawings, wherein.

DETAILED DESCRIPTION OF ILLUSTRATIVE EMBODIMENTS

Figure 1:
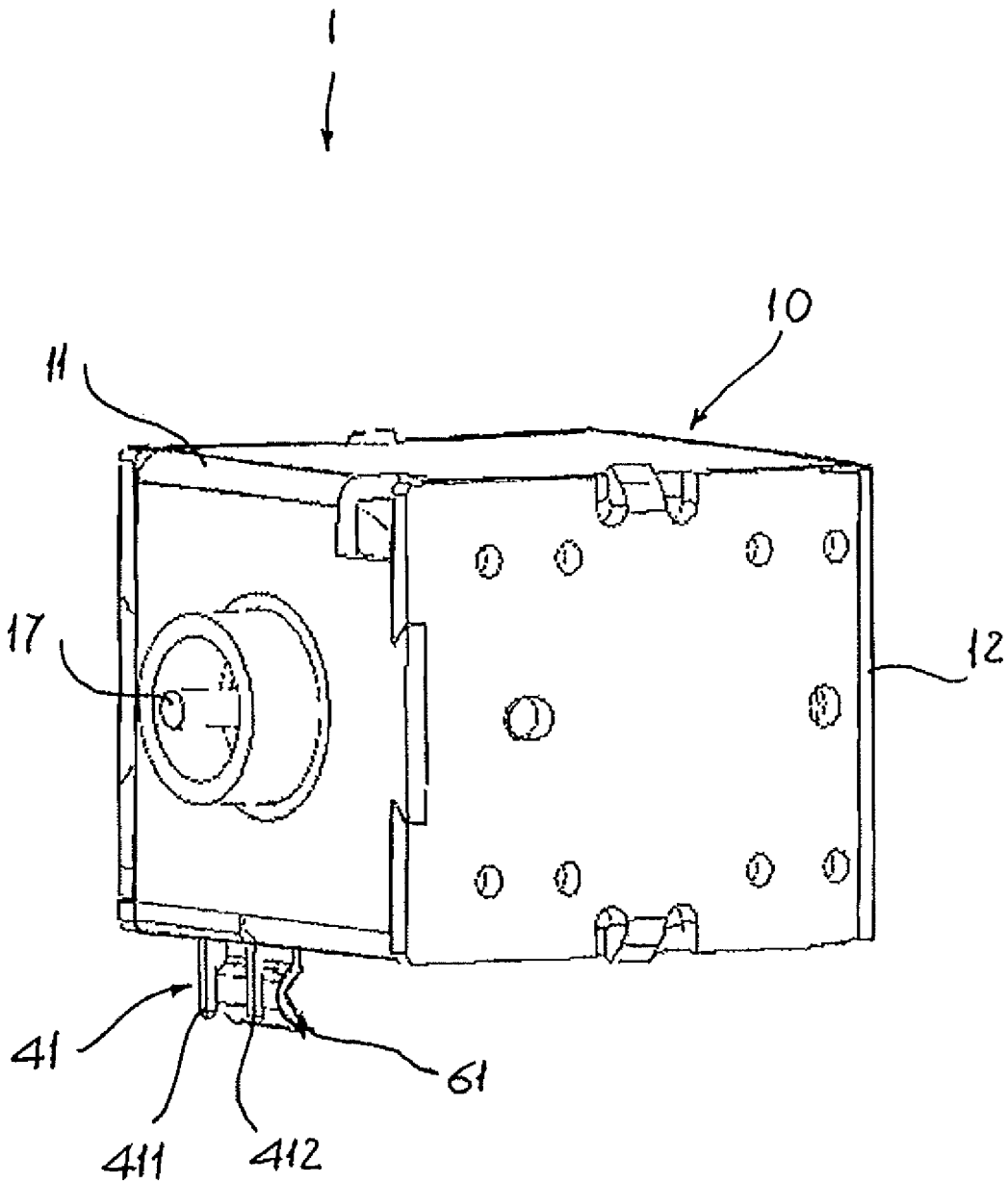
FIG. 1 is a perspective view of a first embodiment of a single-coil actuator according to the invention.
Figure 2:
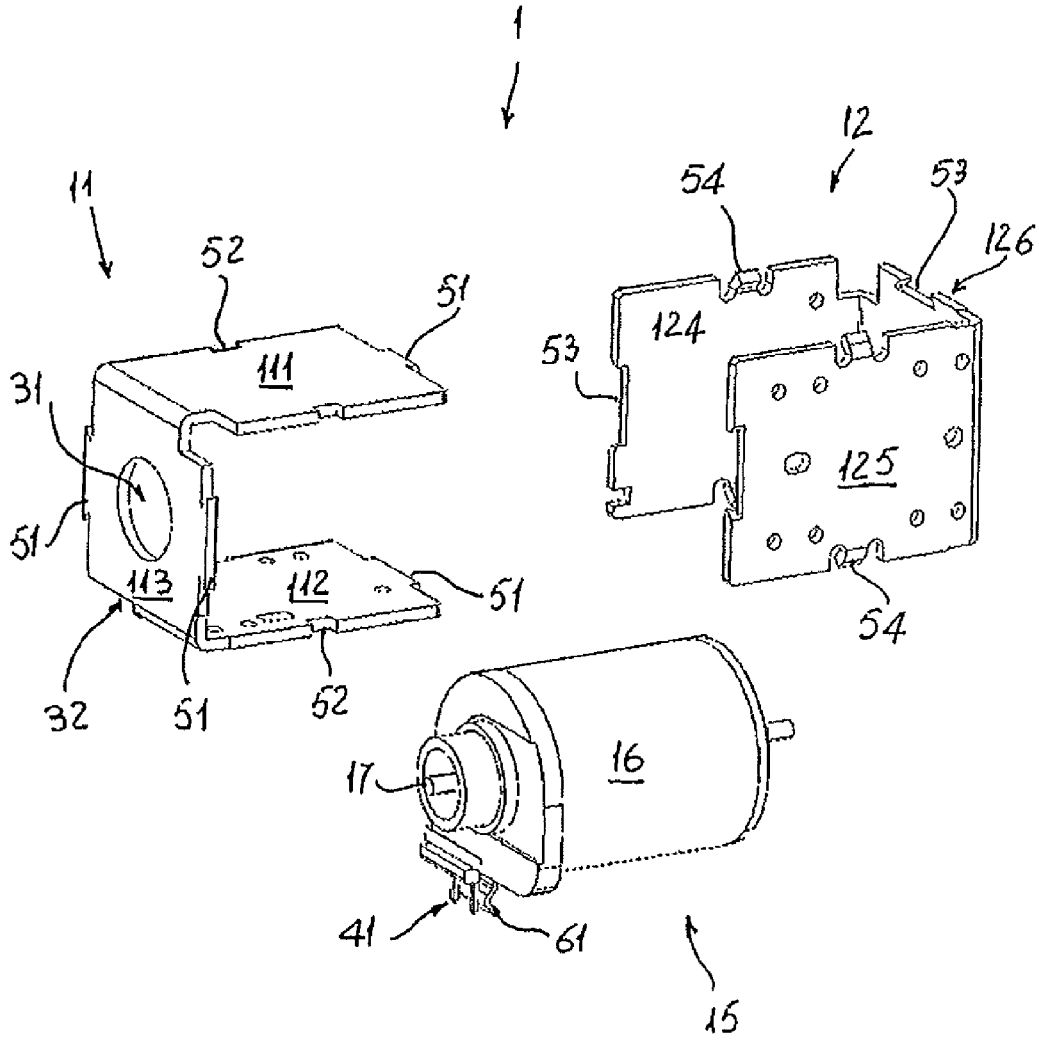
FIG. 2 shows an exploded view of the single-coil actuator of FIG. 1.
Figure 3:
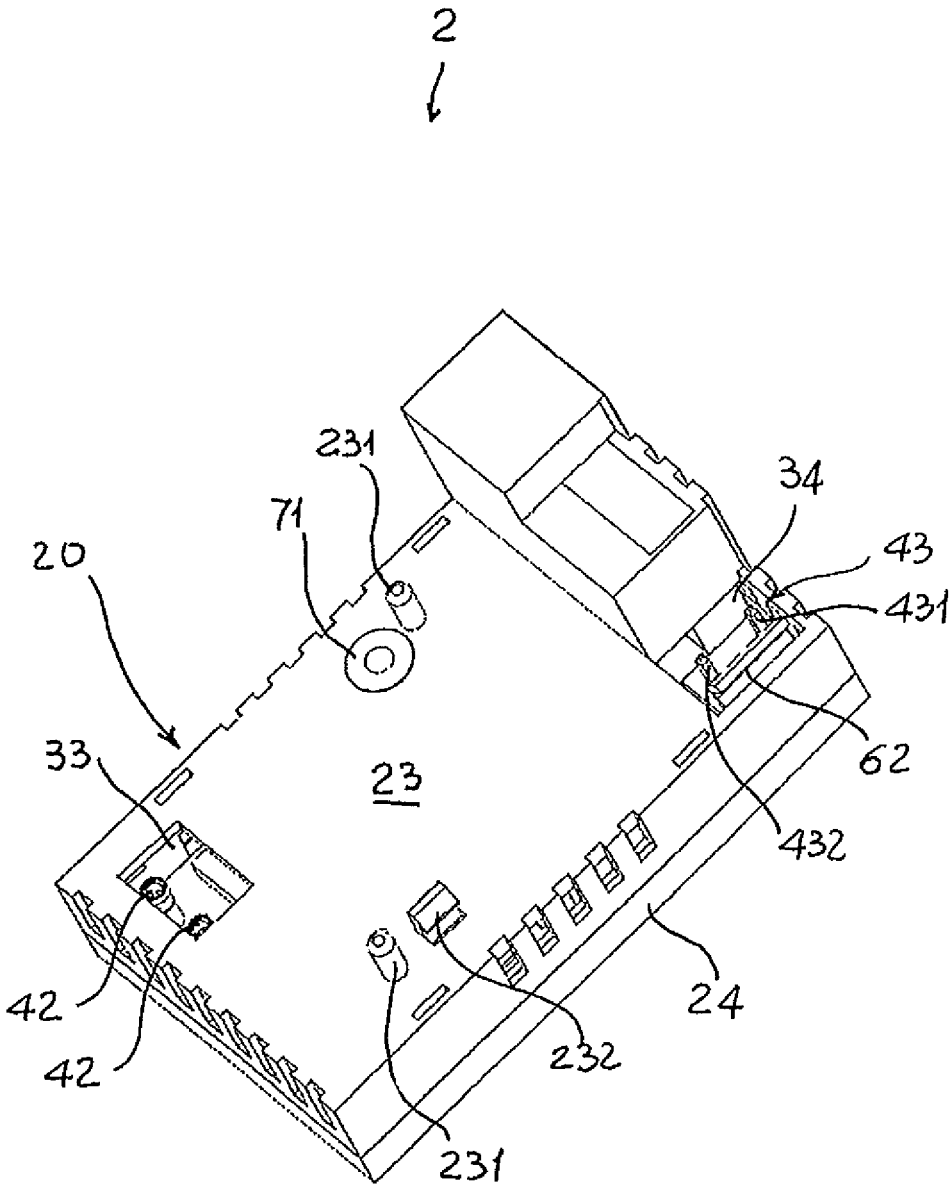
FIG. 3 is a perspective view of a detail of a second embodiment of a single-coil actuator according to the invention, showing an electronic assembly coupable to single-coil actuator according to the invention.
Figure 4:
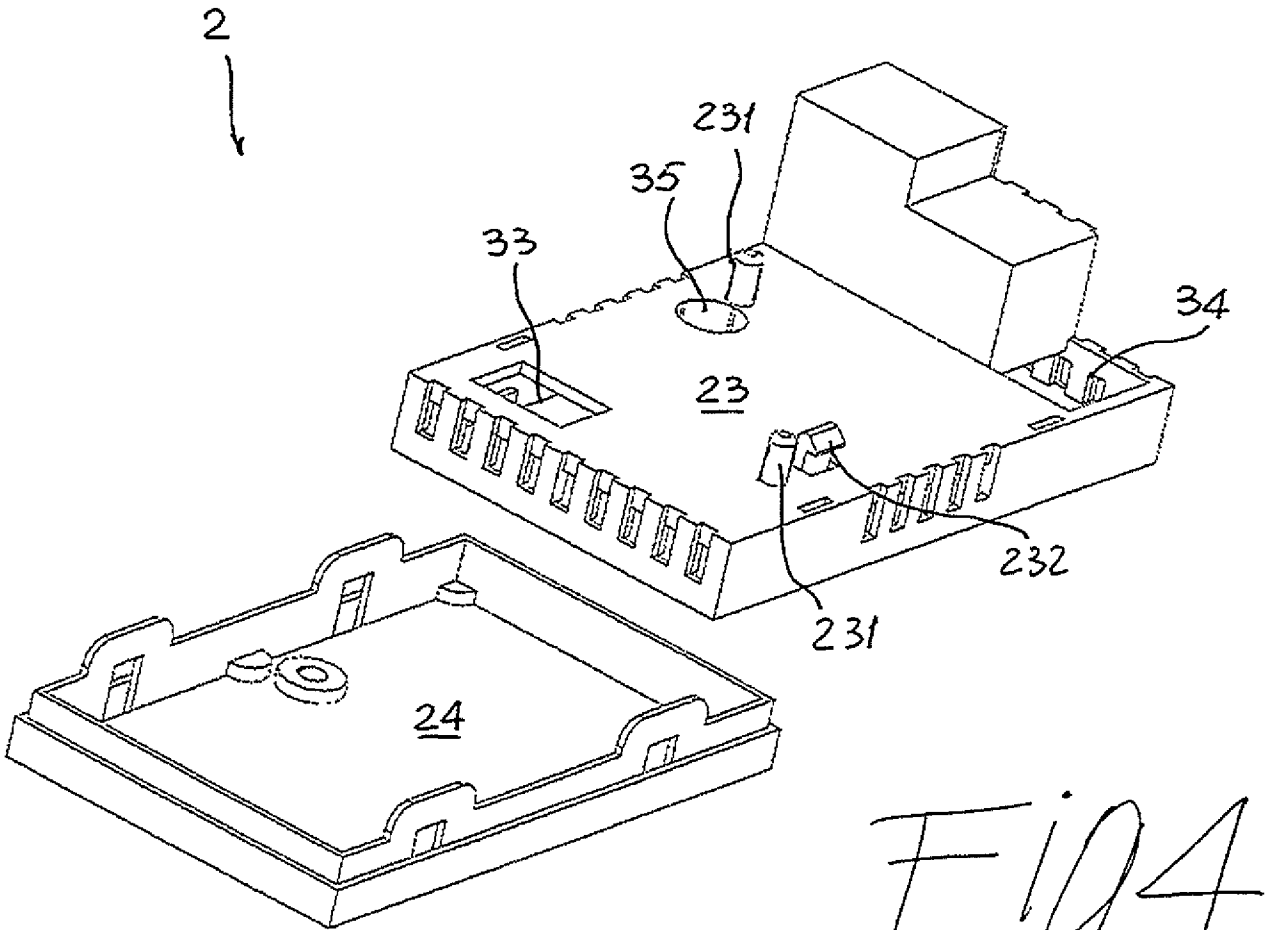
FIG. 4 shows an exploded view of the embodiment of FIG. 1.
Figure 5:
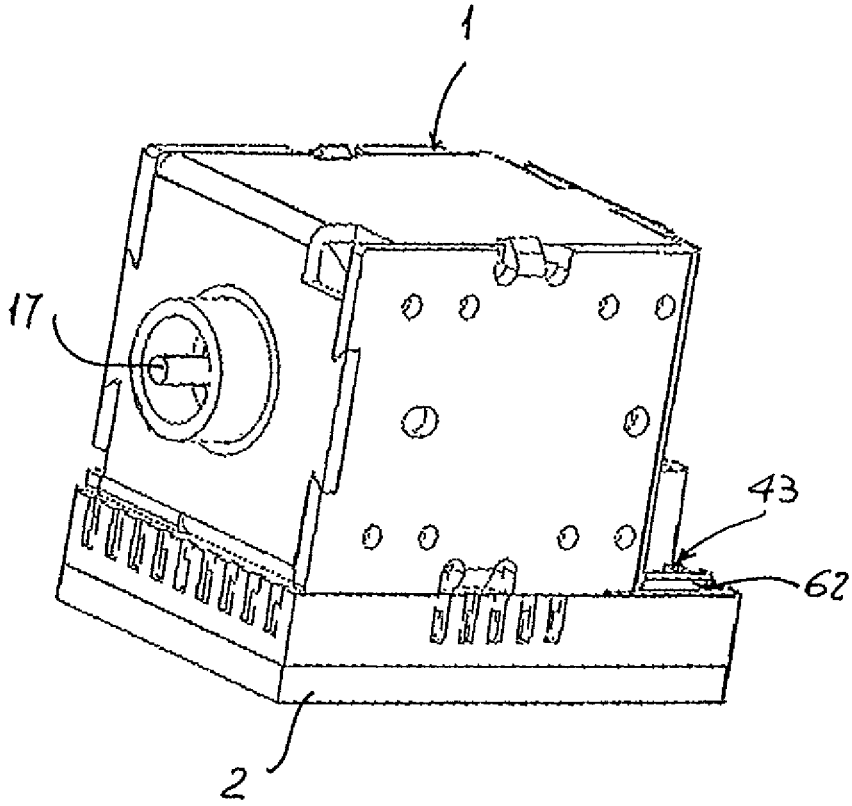
FIG. 5 is a first perspective view of a single-coil actuator according to the invention coupled to the electronic assembly of FIGS. 3 and 4.
Figure 6:
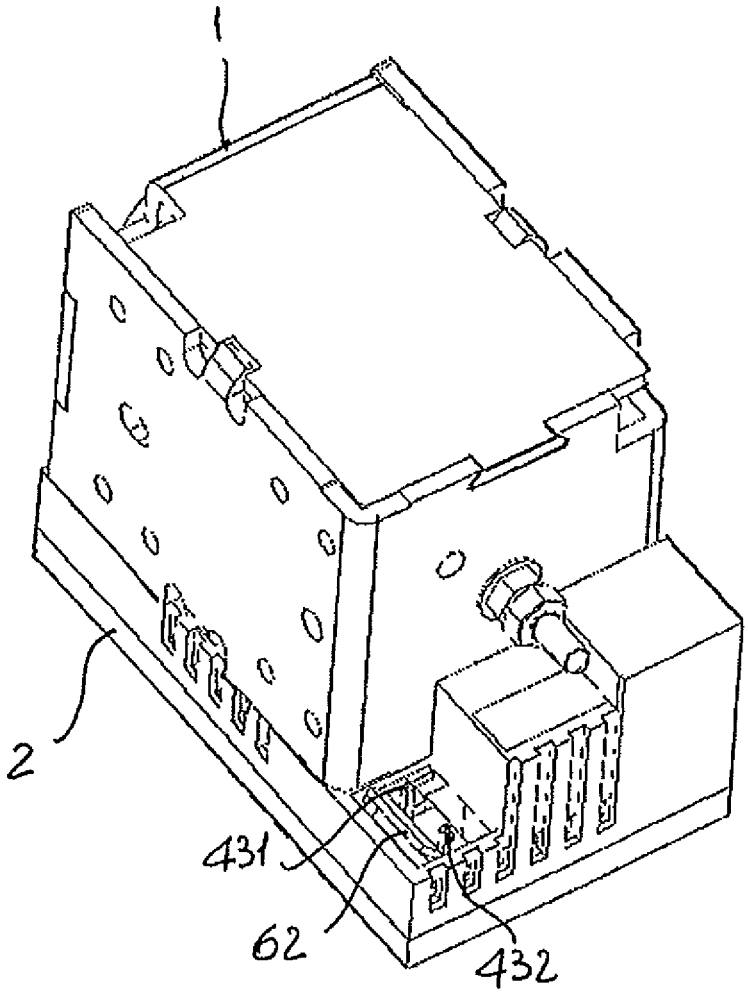
FIG. 6 is a second perspective view of a single-coil actuator according to the invention coupled to the electronic assembly of FIGS. 3 and 4.

With reference to FIGS. 1 and 2, a single-coil actuator for low or medium voltage applications according to the invention, in its more general definition, comprises a first, electromechanical, assembly 1 which comprises a first casing 10.

The first casing 10 has a first half-casing 11 and a second half-casing 12 which are coupled to each other so that said first casing 10 defines an internal space. Within the space defined by the casing 10 an electromagnet 15 is housed, said electromagnet 15 having a coil 16 and an armature 17 movable between two positions. The mechanical coupling of said armature 17 with an external element, e.g. a device of a medium or low voltage apparatus that is actuated by the single-coil actuator, is achieved through a first opening 31 of said first half-casing 11 having for the mechanical coupling. In other words, through the first opening 31, the motion of the armature 17 is imparted to the device which is actuated by the single-coil actuator.

One of the characteristics of the single-coil actuator according to the invention, is that one of said first 11 or second 12 half-casing has a second opening 32 for the electrical connection of the electromagnet 15; in particular said electrical connection comprises a first connection element 41 of the socket and plug-type connection which is electrically connected to said coil 16 and positioned in correspondence of said second opening 32. In this way it is possible to easily connect the coil to a driving electronics in a plug-in mode. The driving electronic can be a dedicated electronic, as better shown hereinafter, or the electronics already on-board of the of the medium or low voltage apparatus in which the actuator is installed. Thus, through the first connection element 41 the coil 16 is energized/de-energized according to the needs, thereby imparting motion or maintaining into position the armature 17 which correspondingly acts on the element to be actuated.

Preferably, as shown in details in FIG. 2, the single-coil actuator according to the invention, comprises a first insulating casing 10 in which said first half-casing 11 is a first U-shaped body having a first 111 and a second 112 walls which extend perpendicularly from a third wall 113; correspondingly, said second half-casing 12 is a second U-shaped body having a fourth 124 and a fifth 125 walls which extend perpendicularly from a sixth wall 126. Thus, by coupling the first 11 and second 12 half-casings to each other, the first casing 10 has a substantially parallelepipedic shape with an internal volume defined by the walls 111, 112, 113, 124, 125, and 126 into which the electromechanical components of the electromagnet can be accommodated.

According to a preferred embodiment, in order to ensure mechanical stability to the assembly 1, said first half-casing 11 comprises first mechanical coupling means 51, 52 positioned on at least one of said first 111, second 112 or third 113 wall. The first mechanical coupling means 51, 52 are mechanically coupled with corresponding second mechanical coupling means 53, 54 which are positioned on at least one of said fourth 124, fifth 125 or sixth 126 wall of said second half-casing 12.

As shown in FIG. 2, the first mechanical coupling means 51, 52 can be conveniently positioned on the edges of said first 111, second 112 or third 113 walls of the first half-casing 11, and, in the same way, the corresponding second mechanical coupling means 53, 54 are conveniently positioned on the edges of said fourth 124, fifth 125 or sixth 126 wall of the second half-casing 12.

Although the mechanical coupling means can be chosen among a wide variety of means, it preferred to use mechanical coupling means that can be easily coupled-uncoupled so as to simplify the manufacturing and assembling of the casing 10. For instance, as shown in FIG. 2, said first and second mechanical coupling means can be of the dove-tail type 51, 53, the coupling being obtained by simply sliding the parts into each other. Alternatively or additionally, the first and second mechanical coupling means can be snap-fit type 52, 54. According to the embodiment shown in the figures a coupling of this kind can be obtained using one or more elastic teeth 54, positioned, e.g., on the edges of the second half-casing 12, that engage in corresponding seats 52, positioned, e.g., on the edges of the first half-casing 11. Alternatively, the elastic teeth could of course be also positioned on the edges of the first half-casing 11 with the corresponding seats being positioned on the edges of the second half-casing 12.

According to a preferred embodiment, the single-coil actuator according to the invention comprises a first insulating and retention element 61 which is positioned in correspondence of the first connection element 41 of said socket and plug-type connection. Preferably, the retention element 61 extends through the second opening 32 so as to mechanically engage the counterpart connector of the first connection element 41. To this purpose, the retention element 61 is shaped so as to allow mechanical retention between the connection element 41 and its counterpart connector. In the embodiment shown in the figures, the first connection element 41 is a two-pins connection element; in this case, the retention element 61 is a tongue of insulating material which extends through the second opening 32 and is shaped so as to elastically engage a corresponding socket connection element into which the first connection element 41 is inserted. Additionally, being made of insulating material, the retention element 61 allows also to increase the withstanding voltage of the isolation between the coil winding and ground.

In a particularly preferred embodiment of the single-coil actuator for low or medium voltage applications according to the invention, shown in FIGS. 3-6, the single-coil actuator comprises a second, electronic, assembly 2 which is operatively coupled to said first, electromagnetic, assembly 1.

In particular, according to this embodiment, said second assembly 2 comprises a second insulating casing 20 which has a third half-casing 23 and a fourth half-casing 24 coupled to each other. In this way, the second casing 20 defines an internal space into which dedicated electronic components (not shown) of the actuator are housed, said electronic components being operatively coupled to said electromagnet 15. The electronic components can be, e.g., an electronic board for controlling the status and driving the operation of the electromagnet 15.

In order to have operative connection between the electronics and the electromagnet 15, one of said third 23 or fourth 24 half-casings is provided with a third opening 33 for the electrical connection between said electronic components and said electromagnet 15. To this purpose, a second connection element 42 of the socket and plug-type connection, which is electrically connected to said electronic components, is positioned in correspondence of said third opening 33 and is coupled to said first connection element 41.

In practice the first and second connection elements 41, 42 constitute the two counterparts of a socket and plug connection that can be easily coupled and uncoupled, without any needs of connecting cables and related manual forming and soldering operation as in the coil-based actuator of known type.

Preferably, the single-coil actuator according to the invention comprises a second, electronic, assembly 2 in which one of said third 23 or fourth 24 half-casing has a fourth opening 34 for the electrical connection between said electronic components and an external element. To this purpose, a third connection element 43, of the socket and plug-type connection, is positioned in correspondence of said fourth opening 34.

According to this advantageous embodiment, the third connection element 43 has substantially the same design as said first connection element 41. In this way the flexibility of use of the single-coil actuator according to the invention is greatly increased. In practice, if a dedicated electronics in not necessary, the first, electromechanical, assembly 1 can be electrically coupled directly to the medium or low voltage apparatus through the first connection element 41.

When a dedicated electronics is needed, said electronics is housed in the second, electronic, assembly 2 which is electrically coupled to the first, electromechanical, assembly 1 through the first and second connection elements 41 and 42. In turn, the second, electronic, assembly 2 can be electrically coupled directly to the medium or low voltage apparatus through the third connection element 43. Being that the first 41 and third 43 connection elements have substantially the same design, all compatibility problems between different product are solved, since the interface (i.e. the connection elements 41 and 43) is substantially the same.

According to the embodiments shown in the figures, the first 41 and third 43 connection elements are a two-pins (respectively 411, 412 and 431, 432) plug element; consequently, said second connection element 42 is a socket element which is coupled to the two-pins 411, 412 plug element 41. It is also possible to have the opposite solution, i.e. the first connection element 41 designed as a socket element and the second connection element 42 designed as a plug element. In such a case also the third connection element 43 is designed as a socket element.

According to a preferred embodiment, the single-coil actuator according to the invention comprises a second insulating and retention element 62 which is positioned in correspondence of the third connection element 43 of said socket and plug-type connection. Preferably, the retention element 62 extends through the fourth opening 34 so as to mechanically engage the counterpart connector of the first connection element 43. To this purpose, the retention element 62 is shaped so as to allow mechanical retention between the connection element 43 and its counterpart connector. In the embodiment shown in the figures, the third connection element 43 is a two-pins connection element; in this case, the retention element 62 is a tongue of insulating material which extends through the fourth opening 34 and is shaped so as to elastically engage a corresponding socket connection element into which the third connection element 43 is inserted. Additionally, being made of insulating material, the retention element 62 allows also to increase the isolation performances.

In a particularly preferred embodiment of the invention, the single-coil actuator comprises a grounding connection 71 between said electronic components housed in the second assembly 2 and the electromagnet 15 housed in the first assembly 1. In this regard, the electromagnet 15 is provided with a metallic enclosure which is put into electrical contact with the electronic board housed in the second assembly 2.

According to this embodiment, one of said third half-casing 23 or fourth half-casing 24 of said second, electronic, assembly 2, advantageously comprises a fifth opening 35 for the grounding connection between said electronic components and said electromagnet 15. The electrical contact and the ground connection between the electromagnet 15 and the electronic board can be achieved, e.g., with a metallic cylinder extending from the electronic board to the metallic enclosure of the electromagnet 15, through the fifth opening 35 of said third half-casing 23 or fourth half-casing 24.

Preferably, in order to ensure mechanical stability of the combination of the first assembly 1 with a second assembly 2, one of said third half-casing 23 or fourth half-casing 24 of said second, electronic, assembly 2 comprises mechanical coupling means for coupling with said first, electromagnetic, assembly 1. For instance, the mechanical coupling between the first and second assembly 1 and 2, can be achieved through pins 231 which are positioned on the third half-casing 23 and/or through one or more teeth 232 which are also positioned on the third half-casing 23. In this case, correspondingly, the first casing 10 is provided with holes that can be positioned, e.g., on the first half-casing 11, into which the pins 231 can enter and/or the tooth 232 enter and engage.

It is clear from the above that the single-coil actuator for low or medium voltage applications of the invention has a number of advantages with respect to similar actuators of known type having the same functionality. In particular, it is possible to interface the actuator either directly with a medium or low voltage apparatus or with a dedicated electronics housed in the second assembly. Being that the electrical interface of the first assembly and second assembly towards external elements (i.e. a medium or low voltage apparatus) is the same all problems of compatibility are solved. This allows for a reduction of the number of variants, thereby reducing the manufacturing, installation and maintenance costs.

Moreover, its simplified construction and operating concepts allows further saving of costs. In particular, the use socket and plug-type connections allows to easily and directly interface electrically the single-coil actuator either with dedicated electronics or with electronics already on-board of the medium or low voltage apparatus in which the actuator is installed, without any needs of connecting cables and related manual forming and soldering operation as in the coil-based actuator of known type. Moreover, the reduced number of parts (first and second half-casings, electromagnet, connections), their mechanical structure and their assembly is extremely simplified, with consequent lowering of manufacturing and assembly costs.

The single-coil actuator for low or medium voltage applications thus conceived may undergo numerous modifications and come in several variants, all coming within the scope of the inventive concept. Moreover, all the component parts described herein may be substituted by other, technically equivalent elements. In practice, the component materials and dimensions of the device may be of any nature, according to need and the state of the art.

What is claimed is:

1. A single-coil actuator for low or medium voltage applications comprising:

a first assembly which comprises a first casing having a first half-casing and a second half-casing coupled to each other, said first casing defining an internal space housing an electromagnet having a coil and an armature movable between two positions, said first half-casing having a first opening for the mechanical coupling of said armature with an external element, one of said first or second half-casing having a second opening for the electrical connection of said electromagnet, said electrical connection comprising a first connection element of a socket and plug-type connection which is electrically connected to said coil and positioned in correspondence of said second opening, and wherein said single-coil actuator further comprises a second assembly operatively coupled to said first assembly, said second assembly comprising a second insulating casing having a third half-casing and a fourth half-casing coupled to each other, said second casing defining an internal space housing electronic components operatively coupled to said electromagnet, one of said third or fourth half-casings having a third opening for the electrical connection between said electronic components and said electromagnet, a second connection element of the socket and plug-type connection, which is electrically connected to said electronic components, being positioned in correspondence of said third opening and being coupled to said first connection element.

2. The single-coil actuator according to claim 1, wherein said first half-casing comprises first mechanical coupling means positioned on at least one of said first, second or third wall, said first mechanical coupling means being coupled with corresponding second mechanical coupling means positioned on at least one of said fourth, fifth or sixth wall of said second half-casing.

3. The single-coil actuator according to claim 2, wherein said first mechanical coupling means are positioned on the edges of said first, second or third walls of said first half-casing, and in that said second mechanical coupling means are positioned on the edges of said fourth, fifth or sixth wall of said second half-casing.

4. The single-coil actuator according to claim 2, wherein said first and second mechanical coupling means comprise mechanical coupling means of the dove-tail type and/or snap-fit type.

5. The single-coil actuator according to claim 1, further comprising a first insulating and retention element positioned in correspondence of said first connection element of said socket and plug-type connection and extending through said second opening.

6. The single-coil actuator according to claim 1, wherein one of said third or fourth half-casing has a fourth opening for the electrical connection between said electronic components and an external element, a third connection element of the socket and plug-type connection being positioned in correspondence of said fourth opening, said third connection element having substantially the same design as said first connection element.

7. The single-coil actuator according to claim 6, wherein said first and third connection elements are a two-pins plug element, said second connection element being a socket element coupled to said two-pins first connection plug element.

8. The single-coil actuator according to claim 6, further comprising a second insulating and retention element which is positioned in correspondence of said third connection element and which extends through said second opening.

9. The single-coil actuator according to claim 1, further comprising a grounding connection between said electronic components and said electromagnet.

10. The single-coil actuator according to claim 1, wherein said third half-casing of said second assembly comprises mechanical coupling means for coupling with said first assembly.

11. The single-coil actuator according to claim 1, wherein one of said third half-casing or fourth half-casing of said second assembly comprises a fifth opening for a grounding connection between said electronic components and said electromagnet.

12. The single-coil actuator according to claim 1, wherein said first half-casing has a first U-shaped body having first and second walls extending perpendicularly from a third wall, and further wherein said second half-casing has a second U-shaped body having fourth and fifth walls extending perpendicularly from a sixth wall, said first and second half-casings being coupled to each other so as to define a substantially parallelepiped first casing.

* * * * *